US007322068B1

(12) United States Patent
Kim

(10) Patent No.: US 7,322,068 B1
(45) Date of Patent: Jan. 29, 2008

(54) TWO-PART MAGNETIC CLOSURE FOR A TOWEL

(76) Inventor: Hoseong Kim, Cheriville C-1701, Sinjung-Donit, Yangchun-ku, Seoul (KR)

( * ) Notice: Subject to any disclaimer, the term of this patent is extended or adjusted under 35 U.S.C. 154(b) by 125 days.

(21) Appl. No.: 11/395,911

(22) Filed: Mar. 31, 2006

Related U.S. Application Data

(60) Provisional application No. 60/667,860, filed on Apr. 1, 2005.

(51) Int. Cl.
*A47K 7/02* (2006.01)

(52) U.S. Cl. ..... 15/209.1; 15/210.1; 24/3.1; 24/3.11; 24/3.12

(58) Field of Classification Search ..... None
See application file for complete search history.

(56) References Cited

U.S. PATENT DOCUMENTS 3,529,328 A 9/1970 Davison
4,403,366 A * 9/1983 Lucke ..... 15/209.1
5,143,371 A 9/1992 Strahan
5,213,240 A 5/1993 Dietz
5,927,580 A 7/1999 Ward-Llewellyn
6,186,155 B1 * 2/2001 Cheek ..... 134/6
6,292,985 B1 9/2001 Grunberger
6,606,767 B2 8/2003 Wong
2001/0037542 A1 11/2001 Elliott
2003/0019084 A1 1/2003 Wong

* cited by examiner

*Primary Examiner*—David Redding
(74) *Attorney, Agent, or Firm*—Young Basile Hanlon MacFarlane & Helmholdt PC

(57) ABSTRACT

A two part magnetic closure for a towel has a first part including a towel and a double thickness strip of material sewn to the towel at one end and a magnetic disk secured between the double thickness strip of material at the opposing end of the strip. A second part of the closure includes a clasp secured to one end of a second double thickness strip of material. Another magnetic disk of opposite polarity is secured between the second double thickness strip of material. The pair of strips of material provides planar surfaces for rotational and slidable connection and movement of the towel relative to the clasp.

9 Claims, 1 Drawing Sheet

TWO-PART MAGNETIC CLOSURE FOR A TOWEL

This application claims priority of provisional patent application Ser. No. 60/667,860 filed on Apr. 1, 2005.

FIELD OF THE INVENTION

The invention is related to a two-part magnetic closure for a towel. The present invention is particularly related to closures for towels used as sports accessories.

BACKGROUND

Golf towels are a common item to carry with the golf bag during a round of golf. The towels are generally used to clean the hands of the player, his golf balls, golf clubs or other sports equipment. Many golf towels are carried in pockets or in compartments on the golf cart. In this example the golf towel can be easily misplaced resulting in a search through the pockets and compartments. If the player ends up carrying the towel, it can be easily lost while handing from his pocket.

Many other golf towels may include an eyelet hole in one corner of the towel for connection to a ring or clasp located on the golf cart or the golf bag. In this example, the golf towel must be unthreaded from the ring or unhooked from the clasp in order to use the towel away from the golf cart or bag and also to allow the towel to be cleaned. This can be a time consuming process. If the towel remains hooked to the golf cart or bag, it is inconvenient for the player to walk back to his cart or bag to get to the towel after washing the golf ball or club.

SUMMARY OF THE INVENTION

It is the intent of the present invention to address the aforementioned disadvantages. The invention is an improved towel attachment device for the attachment of a towel to an item, such as a golf bag, golf cart or to clothing of a person, the device includes a two part magnetic closure for a towel and a clasp having a latching pin releasably connectable to the item, the improvement includes: means for releasably connecting the towel to the clasp, wherein the towel has a first tab secured thereon having a portion extending beyond one peripheral edge of the towel. The first tab has a magnetically attractable disk secured therein. The clasp has a second tab of flexible material extending therefrom. The second tab has a magnetic disk disposed therein for attracting the magnetically attractable disk in the first tab.

In another aspect of the invention, the disks are disposed between layers of material forming the first and second tabs.

In another aspect of the invention, each tab has a magnetic disk therein.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
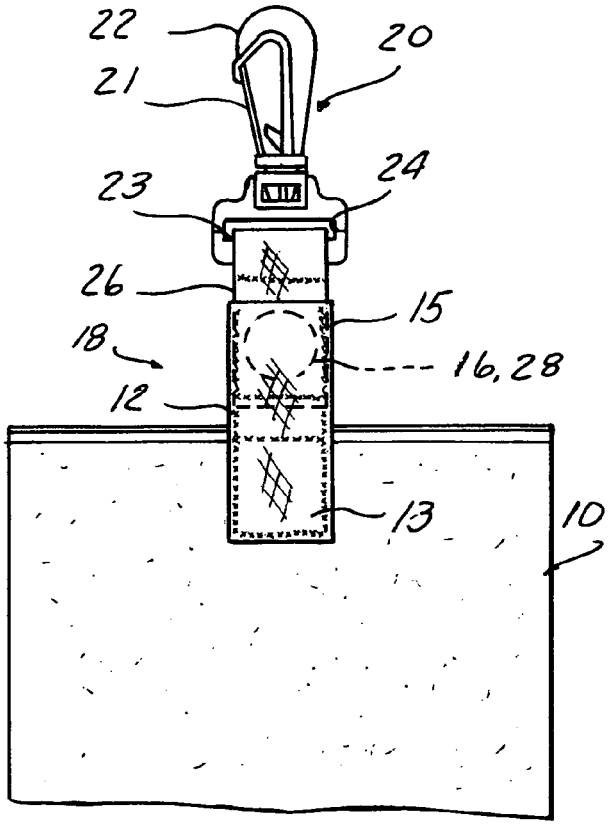
FIG. 1 is a front elevational view of the two-part magnetic closure for a towel having a clasp at one end and the towel at the opposing end, according to the present invention.
Figure 2:
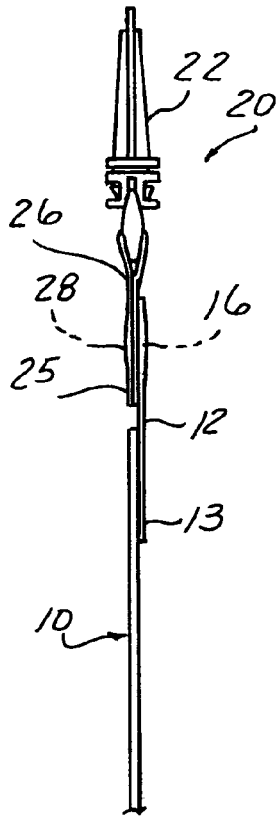
FIG. 2 is a side elevational view of the two-part magnetic closure device for the towel according to the present invention.

Referring to the drawings, FIGS. 1-4, the two-part magnetic closure for a towel device includes a first component 18 including a towel 10 having a strip of flexible material to 12 extending from one end of the towel 10 so that a portion of the strip of flexible material 12 extends out from the peripheral edge of towel 10. The extension strip 12 is preferably folded over into a double thickness defining a first tab 12. The first tab 12 has a first end 13 sewn or otherwise secured to the towel 10. As can be seen in FIG. 2, the first end 13 of the extension strip 16 can be secured to one planar surface of the towel 10. However, as an alternative, each free end of the folded material of the first tab 12 can be sewn or otherwise secured to opposing planar surface of the towel 10.

A distal end 15 of the first tab 12 extends beyond the peripheral edge of the towel 10. The first tab 12 has a flat, disk-shaped magnetically attractable material 16 sewn between the layers of the first tab 12 and adjacent to end 15. The magnetically attractable disk 16 has a flat configuration so that there is no bulkiness in the first tab 12 providing an essentially flat exterior surface area. Further, the magnetically attractable disk 16 is hidden between the doubled over strip of material defining the first tab 12 so that the disk 16 is not visible and does not detract from the look of the towel. The interior location of the disk 16 better secures the disk 16 to the first tab 12.

The two-part magnetic closure for the towel 10 also includes a second component 20. This second component 20 includes a conventional hook-like clasp 22 at the first end 23 having a locking pin 21. The clasp 22 includes a through elongate aperture 24 at one end for threading a second looped strip of material 26 therethough. The second strip of material defines a second tab 26. The two opposing ends 25 of the second tab 26 will have a double thickness of material that is preferably sewn together. Between the double thickness material of the second tab 26 is disposed a flat magnetic disk-shaped member 28, preferably a permanent magnet, made of ferro-magnetic substance having opposite polarity as disk 16. The magnetic disk-shaped member 28 is flat so that the second tab 26 also provides an essentially continuous flat exterior surface. FIG. 2 shows a side view of the device with the magnetically attractable 16, and magnetic disk 28 having opposite polarities attracted and connected to each other. FIG. 2 also illustrates how the first and second tabs 12 and 26 are essentially flat even at the location of the magnetic disks 16 and 28 providing planar contact surfaces of the first and second tabs 12 and 26. The magnetically attractable material may be any material, such as metal or ceramic, listed for example only, that is attracted to the magnetic member 28. Disk 16 may also be a permanent magnet having opposite polarity as magnetic member 28.

During operation, the second component 20 is attached to an item, such as a golf bag, personal clothing or other apparatus by clasping the hook-like clasp 22 onto a portion of the item in a conventional manner to provide a permanent or semi-permanent attachment.

Figure 3:
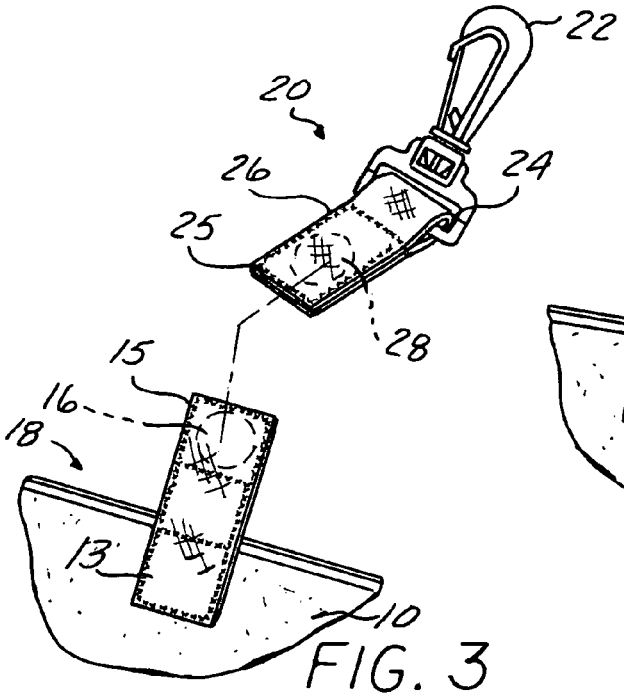
FIG. 3 is a perspective view of the two-part magnetic closure showing the clasp disengaged relative to the towel.
Figure 4:
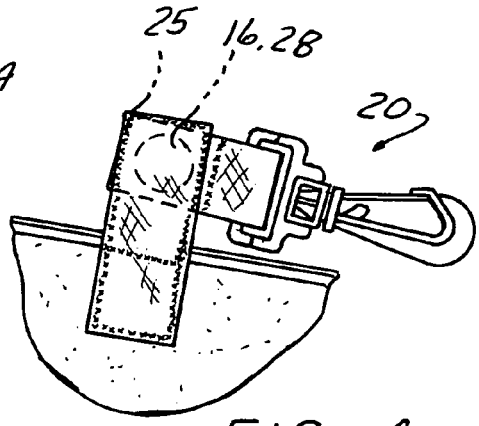
FIG. 4 is the front view of the two-part magnetic closure for the present invention showing the clasp orientated in a different direction relative to the towel.

The end 25 of the second component 20 freely hangs from the clasp 22. The first component 18 is attachable to the magnetic member 28 of the second component 20 when the first component 12 with the disk 16 is brought into close proximity to the magnetic member 28. As can be seen in FIG. 4, the two components 18, 20 do not have to be connected in any particular orientation as long as opposite polarities attract each other. To disengage the first component 18 from the second component 20, the golfer merely pulls on the towel with a pulling force that overcomes the magnetic force of the two magnetic disks 16, 28. FIG. 3 shows the first component 18 including the towel 10 disengaged from the second component 20 including the clasp 22.

The flat surfaces provided by the first and second tabs 12 and 26 respectively and the flat formation of the magnetic disks 16, 28 provide various advantages. One advantage is that the two-part magnetic closure is not bulky as shown in FIG. 2 wherein the first and second tabs 12, 26 are virtually flat including at the location of the magnetic disks 16, 28. Because of the essentially flat surfaces at the disk area, the tabs 12, 26 of the two components 18, 20 are rotatable and slidable with respect to each other. The two components 18, 20 can be positioned in any direction with respect to each other and do not require a particular orientation for connection, except with regard to polarity of the disks 16 and 28.

The two-part magnetic closure provides other advantages, including that the towel 10 can be easily detached and reattached to the hook-like clasp 22 which is permanently or semi-permanently attached to the golf bag or other apparatus. As a result, a golfer can easily pull the towel away from the clasp 22 and bag for use to wipe his hands or clean the golf balls or golf club. The two components 18 and 20 can also be disengaged from each other by sliding one component relative to the other component. The golfer can easily attach the towel back to the golf bag with the use of merely one hand.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law. In one such modification, the conventional clasp 22 may be replaced with another conventional connection means such as a button loop or tie so that the towel and the two part closure can be used in different environments such as kitchens, utility rooms, etc.

What is claimed is:

1. An improved towel attachment device for releasable attachment of a towel to an item, such as golf bag or to clothing of a person, the device includes a towel and a clasp having a latching pin releasibly connectable to the item, the improvement comprising:

means for releasibly connecting the towel to the clasp, wherein the towel has a first tab with a length extending beyond a peripheral edge of the towel said first tab having a magnetically attractable material disposed thereon; and the clasp has a strip of flexible material defining a second tab extending therefrom and wherein the second tab has a magnet disposed therein, wherein the magnetically attractable material is attracted to the magnet.

2. The improvement of claim 1, wherein the second tab is formed of a double layer of flexible material and the magnet is secured between the double layer of flexible material, the magnet having a disk formation for providing a continuous planar contact surface along the length of the second tab.

3. The improvement of claim 2, wherein the first tab is formed of a strip of flexible material folded to form a double layer of the material and the magnetically attractable material is secured between the double layer of material.

4. The improvement of claim 3, wherein each of the magnetically attractable material and magnet are disk-shaped for providing a planar contact surface.

5. The improvement of claim 3, wherein the first tab is rotatable and slidable relative to the second tab when the towel is attached to the clasp.

6. An improved two part latching device for releasably connecting a towel to an item, the device including a towel and a connection means, the connection means releasibly connectable to the item, the improvement comprising:

a first component including the towel having a first tab connected to a portion of the towel, said first tab extending beyond a periphery of the towel and having at least a double thickness forming a first cavity therebetween and a magnetically attractable disk secured in the first cavity; and a second component including the connection means and a second tab secured to the connection means, said second tab formed by a double thickness material forming a second cavity therebetween, and a magnetic disk secured in the second cavity.

7. The improvement of claim 6, wherein the first and second tabs are made of a flexible material.

8. The improvement of claim 6, wherein the first and second tabs have essentially an exposed planar surface.

9. The improvement of claim 6, wherein the first tab is rotatable and slidable relative to the second tab, when the towel is secured to the connection means by the magnetic disk.

* * * * *